US008752563B2

(12) United States Patent
Lieu

(10) Patent No.: US 8,752,563 B2
(45) Date of Patent: Jun. 17, 2014

(54) NAIL POLISHING STENCIL

(76) Inventor: Mai Lieu, Honolulu, HI (US)

( * ) Notice: Subject to any disclaimer, the term of this patent is extended or adjusted under 35 U.S.C. 154(b) by 120 days.

(21) Appl. No.: 12/902,188

(22) Filed: Oct. 12, 2010

(65) Prior Publication Data

US 2011/0303237 A1 Dec. 15, 2011

Related U.S. Application Data

(60) Provisional application No. 61/250,707, filed on Oct. 12, 2009.

(51) Int. Cl.
*A45D 29/00* (2006.01)

(52) U.S. Cl.
USPC ..... 132/285

(58) Field of Classification Search
USPC ..... 132/73, 73.5
See application file for complete search history.

(56) References Cited

U.S. PATENT DOCUMENTS

| | | | | |
|---|---|---|---|---|
| 2,458,709 | A * | 1/1949 | Kayer | 2/21 |
| 5,186,189 | A * | 2/1993 | Harris | 132/285 |
| 5,638,837 | A * | 6/1997 | Juhl et al. | 132/285 |
| 5,645,090 | A * | 7/1997 | Juhl et al. | 132/285 |
| 5,803,094 | A | 9/1998 | Becker | |
| 6,357,451 | B1 | 3/2002 | Carter | |

* cited by examiner

*Primary Examiner* — Rachel Steitz
(74) *Attorney, Agent, or Firm* — L.C. Begin & Associates, PLLC.

(57) ABSTRACT

One embodiment of a stencil for use in applying nail polish to a nail may include a flange. The flange may define an open-ended notch that is adapted to receive at least a portion of the nail. The stencil may also include a retainer extending from the flange. The retainer is adapted to retain the flange on the nail.

16 Claims, 5 Drawing Sheets

NAIL POLISHING STENCIL

CROSS REFERENCE TO RELATED APPLICATION

This application claims the benefit of U.S. Provisional Application No. 61/250,707 filed on Oct. 12, 2009, the disclosure of which is incorporated by reference.

FIELD OF THE INVENTION

The present disclosure generally relates to nail polishing, and, more particularly, to a nail polishing stencil for painting nails, such as fingernails and toenails.

BACKGROUND FOR THE INVENTION

Articles for nail decoration have become an indispensable part of feminine cosmetics. Typically, a brush may be used to completely or partially coat each fingernail of a user's hand, as styling dictates. Such an application may require skill, as well as a significant amount time and effort on a user's part. However, the brush may carry some excess nail polish that may undesirably spill, drip, or splatter offs the end of the brush and onto the skin and other surrounding areas. Such unwanted nail polish is generally removed from the skin, cuticles and/or other surrounding areas by way of a chemical nail polish removing solution, thereby exposing the skin, cuticles and other surfaces to potentially harmful chemicals. Moreover, removing such undesirable nail polish may be a time consuming exercise for a user. These considerations also apply to the painting of toenails. In addition, it may be difficult for right-handed users to apply nail polish on fingernails of right hands using their left hands. Specifically, such users may inadvertently paint outside the fingernails.

SUMMARY OF THE INVENTION

One embodiment of a stencil for use in applying nail polish to a nail may include a flange. The flange may define an open-ended notch that is adapted to receive at least a portion of the nail. The stencil may also include a retainer extending from the flange. The retainer is adapted to retain the flange on the nail.

BRIEF DESCRIPTION OF THE DRAWINGS

The advantages and features of the present disclosure will become better understood with reference to the following detailed description and claim taken in conjunction with the accompanying drawings, in which:

Like reference numerals refer to like parts throughout the description of several views of the drawings.

DETAILED DESCRIPTION OF THE INVENTION

The exemplary embodiments described herein in detail for illustrative purposes are subject to many variations in structure and design. It should be emphasized, however, that the present disclosure is not limited to a particular nail polishing stencil, as shown and described. It is understood that various omissions and substitutions of equivalents are contemplated as circumstances may suggest or render expedient, but these are intended to cover the application or embodiment without departing from the spirit or scope of the present disclosure. Also, it is to be understood that the phraseology and terminology used herein are for the purpose of description and should not be regarded as limiting. The terms "first," "second," and the like, as used herein do not denote any order, quantity, or importance, but rather are used to distinguish one element from another, and the terms "a" and "an" herein do not denote a limitation of quantity, but rather denote the presence of at least one of the referenced item.

The present disclosure provides various embodiments of a nail polishing stencil (hereinafter referred to as "stencil") for applying nail polish to a nail, such as a fingernail or a toenail. The use of the disclosed stencil for applying nail paint may substantially prevent unwanted paint and/or nail polish from spilling and contacting the skin and cuticles surrounding the nail.

Figure 4:
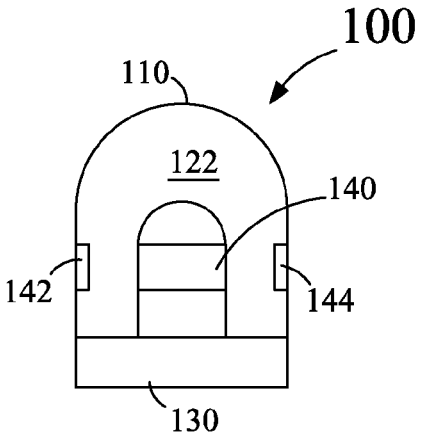
FIG. 4 is a bottom view of the nail polishing stencil of FIG. 1.

Referring to FIGS. 1-4, one embodiment of a stencil 100 may have a flange 110 that may be adapted to surround at least a portion of a nail to be painted. The flange 110 in one form may be a flat U-shaped collar defining an open-ended notch 112. The open-ended notch 112 may receive a portion of a nail 10 (shown in FIG. 3) to be painted, such that the portion of the nail 10 to be painted may be slightly elevated with respect to the collar for readily painting the nail 10. Further, the open-ended notch 112 may also permit the stencil 100 to be removed from the finger or toe without the flange 110 smearing the nail polish. The flange 110 may cover an adjacent portion of a finger/toe and/or the nail 10 not to be painted. The flange 110 may, however, have any suitable shape that may facilitate surrounding of the nail 10 or a portion thereof in a convenient manner. The flange 110 may have a first end portion 114 and a second end portion 116. Further, the flange 110 may have a top surface 120 that may include marking symbols 118, such as numerals 1, 2, and the like for indicating predetermined positions. In addition, the flange 110 may have a bottom surface 122 opposite to the top surface 120 (as shown in FIG. 4).

The stencil 100 may also include a retainer 130 that may be used to carry the stencil 100 on a person's finger or toe. Specifically, the retainer 130 may extend from the bottom surface 122 of the flange 110 between the first and second end portions 114, 116. The retainer 130 may be made of a light weight material, such as an elastomeric material. In one form, the retainer 130 may be a strap extending between the first and second end portions 114, 116 or the extremities of the U-shaped flange 110, such that the retainer 130 may be fixedly carried by the flange 110 at the first and second end portions 114, 116 thereof. Alternatively, the retainer 130 may be partially or completely detachable from the first and second end portions 114, 116.

The stencil 100 may also include a guard 140 that may be attached to or carried by the flange 110 and/or the retainer 130. The guard 140 may be adapted to protect the nail polish on the nail 10, thereby preventing the painted nail 10 from being accidentally smeared. The guard 140 may be an arcuate band that is radially spaced apart from the center of the open-ended notch 112. It should be understood that in the present description, the guard 140 is explained with reference to the stencil 100 and the flange 110. Further, the guard 140 may be removably coupled to the flange 110. Specifically, the guard 140 may include a pair of protruding members 142, 144 configured to slidably receive the flange 110 therethrough. Accordingly, the guard 140 may be easily removed from the stencil 100 after use by sliding the guard 140 outwards from the flange 110. The guard may also be adjustably coupled to the flange and/or, the retainer, thereby enabling the position or configuration of the guard to be adjusted while remaining coupled to the flange and/or retainer. For example, the guard may be rotatably coupled to the flange so as to allow the guard to be rotated out of a nail-covering position during application of the nail polish. The guard may then be rotated into a configuration in which it covers the nail after application of the polish. Other methods of coupling the guard to the flange and/or retainer are also contemplated.

Figure 1:
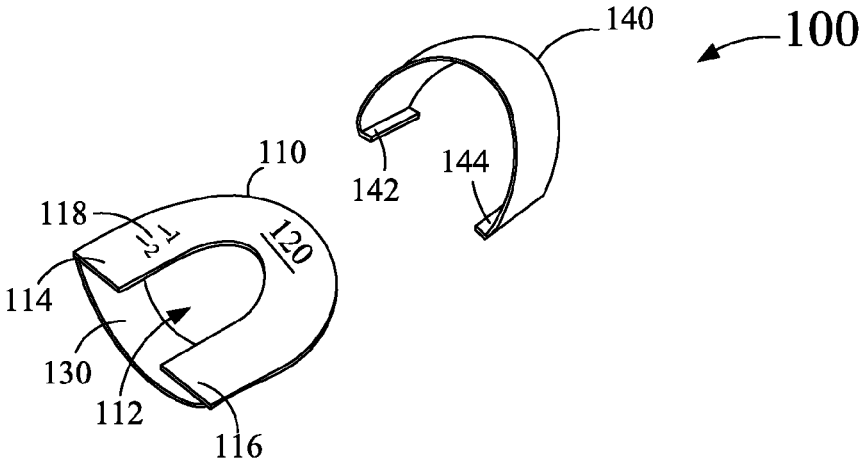
FIG. 1 is an exploded perspective view of an embodiment of a nail polishing stencil.
Figure 2:
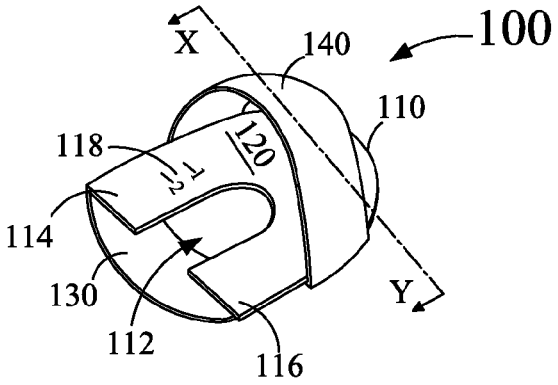
FIG. 2 is an assembled perspective view of the nail polishing stencil of FIG. 1.
Figure 3:
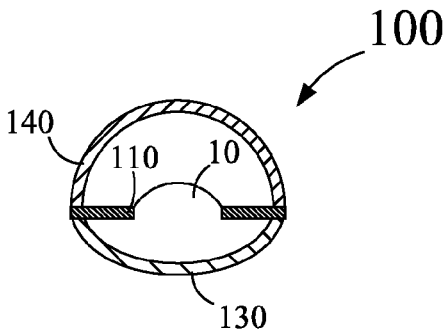
FIG. 3 is cross-sectional view as taken along line X-Y of FIG. 2, showing the nail polishing stencil providing unimpeded access to the nail for painting the same.
Figure 5:
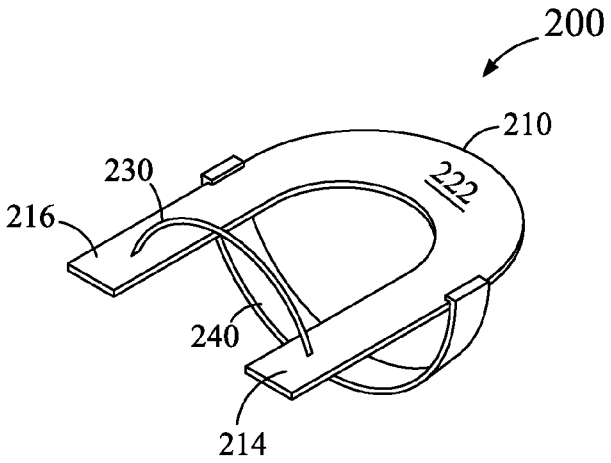
FIG. 5 is a bottom perspective view of another embodiment of a nail polishing stencil.

As shown in FIG. 5, another embodiment of a stencil 200 may have a flange 210 with a bottom surface 222, and may be similar to the stencil 100 of FIG. 1 having the flange 110. The flange 210 may be configurationally and functionally similar to the flange 110, and may have a first end portion 214 and a second end portion 216. Further, the stencil 200 may include a retainer 230, similar to the stencil 100 of FIG. 1 having the retainer 130. However, the retainer 230 may be a thinner strip as compared to the retainer 130. The retainer 230 may extend between the first and second end portions 214, 216 of the flange 210 for carrying the stencil 200 on the fingertip or toe. The retainer 230 may be made of a light weight material such as an elastomeric material. The stencil 200 may also include a guard 240 that may be configurationally and functionally similar to the guard 140 of the stencil 100.

Figure 6:
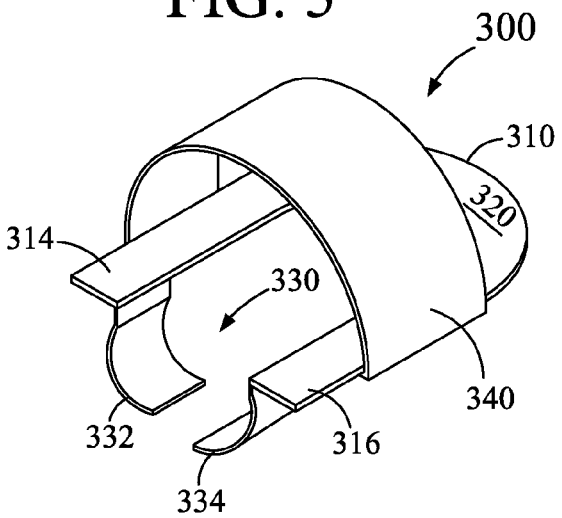
FIG. 6 is a top perspective view of still another embodiment of a nail polishing stencil.

Referring to FIG. 6, still another embodiment of a stencil 300 may have a flange 310 with a top surface 320, and may be similar to the stencil 100 of FIG. 1 having the flange 110. The flange 310 may be configurationally and functionally similar to the flange 110, and may have a first end portion 314 and a second end portion 316. Further, the stencil 200 may include a retainer 330. In the embodiment shown in FIG. 6, the retainer 330 comprises a split ring having a first portion 332 extending from the first end portion 314 and a second portion 334 extending from the second end portion 316. The first and second portions 332, 334 may be resiliently deflectable receive and retain therebetween finger tips or toes of various sizes. Thus, the ring shaped retainer 330 may be openable to fit different sizes of nails. The stencil 300 may also include a guard 340 that may be configurationally and functionally similar to the guard 140 of the stencil 100. However, the guard 340 may have substantially wider than the guard 140 to cover more of the nail 10.

Figure 7:
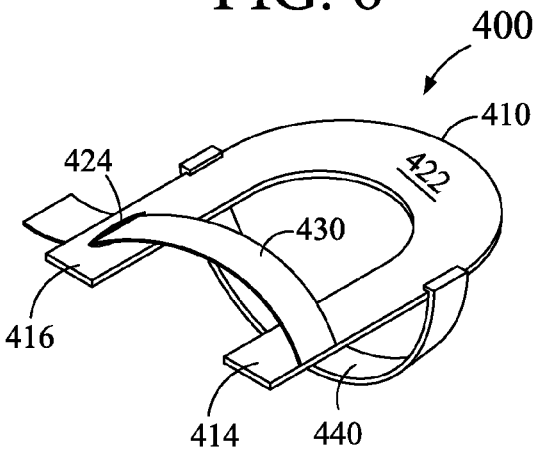
FIG. 7 is a bottom perspective view of yet another embodiment of a nail polishing stencil.

Referring to FIG. 7, yet another embodiment of a stencil 400 may have a flange 410 with a bottom surface 422 and a retainer 430 extending from the flange 410 may be similar to the stencil 100 of FIG. 1 respectively having the retainer 130 and the flange 110. However, the flange 410 may have a first end portion 414 that may include a slit 424 and a second end portion 416 opposite to the first end portion 414. Further, the retainer 430 in this form may be a strap having a fixed end attached to the second end portion 416 of the flange 410, and a free end configured to be received in the slit 424, and fastened thereto for retaining the stencil 400 on the finger or toe. The stencil 400 may also include a guard 440 that may be configurationally and functionally similar to the guard 140 of the stencil 100.

Figure 8:
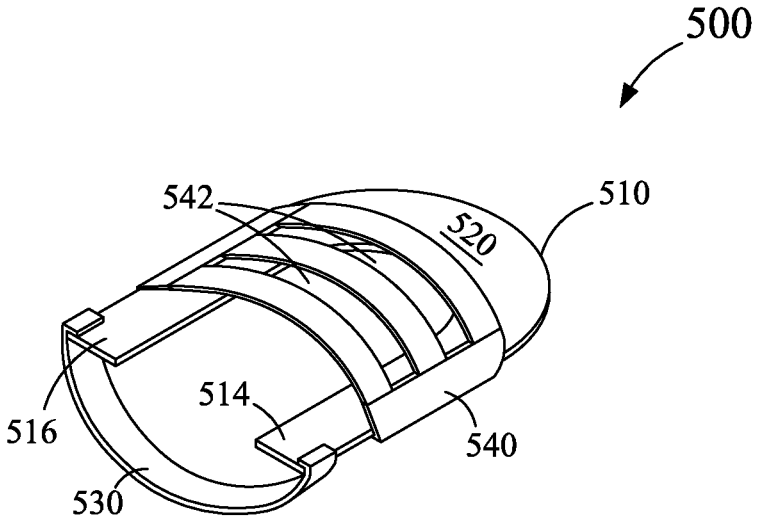
FIG. 8 is a top perspective view of another embodiment of a nail polishing stencil.
Figure 9:
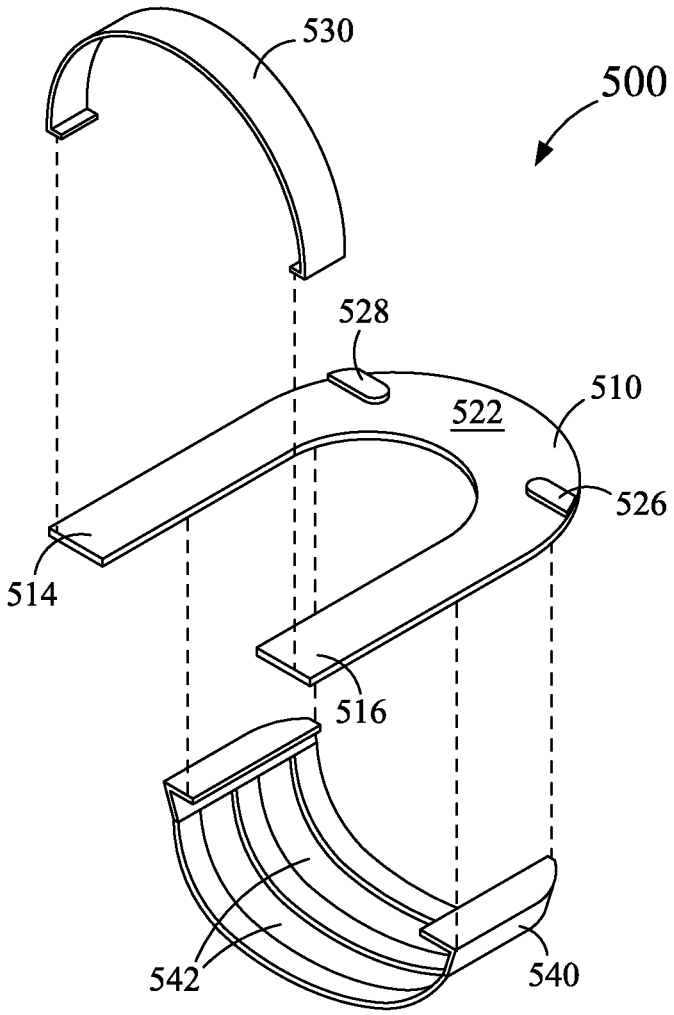
FIG. 9 is an exploded perspective view of the nail polishing stencil of FIG. 8, showing the stencil having a one piece guard with a pair of slots for ventilating the painted nail.

Referring to FIGS. 8 and 9, another embodiment of a stencil 500 may include a U shaped flange 510. The flange 510 may be configurationally and functionally similar to the flange 110, and may have a first end portion 514 and a second end portion 516. Further, the flange 510 may have a top surface 520 and a bottom surface 522. The stencil 500 may also have a retainer 530 that may extend between the first end portion 514 and the second end portion 516. In the present embodiment, the retainer 530 may be removably attached with the flange 510, particularly, the retainer 530 may include protruding members (not numbered) configured to slidably receive by the flange 510. Further, the stencil 500 may optionally include a pair of protrusions 526, 528 carried by a respective one of opposing sides of the bottom surface 522 of the flange 510. In addition, the stencil 500 may also include a guard 540 carried by the flange 510, such that the protrusions 526, 528 may limit movement of the guard 540 on the flange 510. Moreover, the guard 540 may be removably coupled to the flange 510 in a manner similar to that of the guard 140 of the stencil 100 of FIG. 1. Accordingly, the guard 540 may be easily removed from the stencil 500 after use by sliding the guard 540 outwards from the flange 510. In the present embodiment, the guard 540 may have one-piece configuration with three strips defining a pair of slots 542 for ventilating a painted nail. Alternatively, the guard 540 may have configuration with any number of strips or slots. In addition, the guard 540 may have an end sleeve extending outwardly from the guard 540 in a direction parallel to the flange 510. The end sleeve may be removably sealed on a portion of a nail for creating various nail painting designs. Further, the arrangement of the protrusions 526, 528 may be assembled with any shape of the guard 540.

Figure 10:
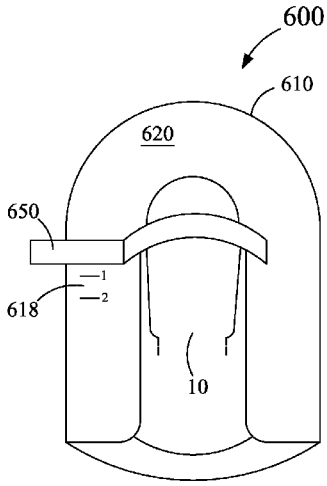
FIG. 10 is a top perspective view of another embodiment of a nail polishing stencil, showing the stencil having a mask member.

As shown in FIG. 10, another embodiment of a stencil 600 may have a flange 610 and may be similar to the stencil 100 of FIG. 1 having the flange 110. The flange 610 may have a top surface 620 that may include marking symbols 618, such as numerals 1, 2, and the like for indicating predetermined positions. The stencil 600 may further include a mask member 650 that may be carried by the top surface 620 of the flange 610 and may be a flat tape for creating a flat French tip impression on a user's fingernail, for example. The mask member 650 may be constructed and arranged to cover one or more portions of the nail 10, such that the mask member 650 may block the application of the nail polish to the covered one or more portions of the nail 10 to create French tip impressions thereon. Further, the mask member 650 may be carried at a predetermined position on the top surface 620 of the flange 610 for creating the flat French tip impression on the nail 10. The predetermined position may be indicated by means of the marking symbols 618 for selecting a desired portion on the nail 10 to be painted. The stencil 600 may additionally include a guard that is not shown in FIG. 10 for the purposes of description and illustration of the mask member 650.

Figure 11:
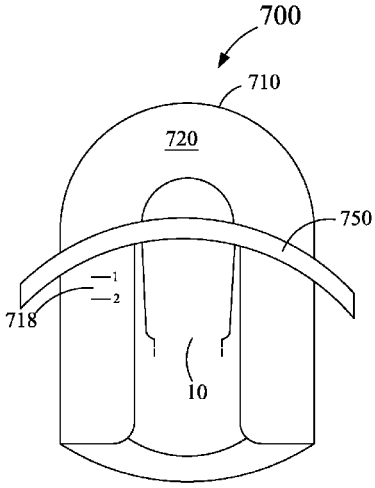
FIG. 11 is a top perspective view of still another embodiment of a nail polishing stencil, showing the stencil having a mask member that has a curved shape.

Referring to FIG. 11, another embodiment of a stencil 700 may have a flange 710 with a top surface 720 and a mask member 750, and may be similar to the stencil 600 of FIG. 10 respectively having the flange 610 and the mask member 650. However, the mask member 750 may have a curved shape, and specifically, the mask member 750 may be a curved tape for creating a curved-French tip impression on the nail 10. Further, the mask member 750 may be carried at a predetermined position on the top surface 720 of the flange 710 for creating the curved French tip impression on the nail 10. The predetermined position may be indicated by means of marking symbols 718, such as 1, 2, and the like printed on the top surface 720 for selecting a desired portion on the nail 10 to be painted. The stencil 700 may additionally include a guard that is not shown in FIG. 11 for the purposes of description and illustration of the mask member 750.

Figure 12:
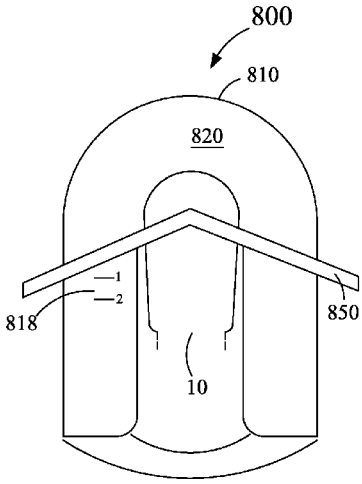
FIG. 12 is a top perspective view of yet another embodiment of a nail polishing stencil, showing the stencil having a mask member that has a generally V-shaped apex.

Referring to FIG. 12, yet another embodiment of a stencil 800 may have a flange 810 with a top surface 820 and a mask member 850, and may be similar to the stencil 600 of FIG. 10 respectively having the flange 610 and the mask member 650. However, the mask member 850 may have generally V-shaped apex, and specifically, the mask member 850 may be a V-shaped tape for creating a V-shaped impression on the nail 10. Further, the mask member 850 may be carried at a predetermined position on the top surface 820 of the flange 810. The predetermined position may be indicated by means of marking symbols 818, such as 1, 2, and the like printed on the top surface 820 for selecting a desired portion on the nail 10 to be painted. The stencil 800 may additionally include a guard that is not shown in FIG. 12 for the purposes of description and illustration of the mask member 850.

The stencil disclosed in the present disclosure may have different sizes and shapes based on the sizes and shaped of nails of the users. It may be evident to a person skilled in the art that the shape of the flange as shown in FIGS. 1 through 12 as set forth herein is for purposes of illustration and is not to be construed as limiting.

In one form, the stencil such as the stencils 100-800, may be made of a lightweight and durable material, for example plastic, metal, paper, tape, foil, and the like. The above mentioned material of construction of the stencils may not be considered as limiting the scope of the present disclosure.

In use, the stencil such as the stencil 100 may be adapted to be worn around a tip of a nail of a user for applying nail-polish. More specifically, the flange 110 may receive a portion of the nail to be painted and the retainer 130 may retain the stencil 100 to the nail of the user.

Once the stencil 100 is worn by the user on the fingertip or toe, the user may easily apply the nail polish on the fingernail without having any significant amount of unwanted nail polish contacting the adjacent skin, cuticles and or other surfaces of the nail. Accordingly, the stencil 100 allows a relatively efficient, neat, and quick application of the nail polish to the nail. Further, the guard 140 may be utilized to protect the nail polish on the nail from being accidentally smeared. The guard 140 may easily be removed after using the stencil 100. As described hereinabove, the aforementioned method of using the stencil of the present disclosure has been explained with reference to FIGS. 1-4 for stencil 100. However, it may be evident that such method may also be applicable for using the stencils 200-800.

Further, in order to create impressions such as French tips, and the like, on nails, a stencil, such as the stencils 600-800, may be provided. For example, the mask member 650 of the stencil 600 may block the application of the nail polish to a covered section on the nail 10. Specifically, the mask member 650 may provide a flat French tip design on the nail 10. More specifically, the mask member 650 may be placed on the marking symbol 618. Subsequently, a nail polish having a specific color may be applied on a bottom edge of the nail 10. Thereafter, the mask member 650 may be removed, and a nail polish of another color or a clear coat may be applied on at least a portion of the nail 10.

Similarly, the stencil 700 with the mask member 750 may be used for obtaining a curved French tip design on the nail 10. Further, the stencil 800 with the mask member 850 may be used for obtaining a V-shaped design on the nail 10. Also, the stencils 600-800 may be provided with the marking symbols 618, 718, and 818, respectively, such that the user may place the mask members 650, 750, and 850 at desired sections on his/her nails to have desired lengths of impressions on the nails.

The stencil disclosed herein may enable a user to manually apply the nail polish without having any significant amount of unwanted nail polish contacting the adjacent skin, cuticles and or other surfaces of the nail. The stencil may also enable a right-handed user to comfortably apply nail polish on nail of his or her right hand without inadvertently painting outside the nails, when using a left hand thereof for painting. Further, the stencil may also be manufactured for toenails for applying nail polish on the toenails. Furthermore, different sized stencils may be provided as a cosmetic kit, and accordingly, the user may use the cosmetic kit for polishing nails at home, thereby saving time and money.

The foregoing descriptions of specific embodiments of the present disclosure have been presented for purposes of illustration and description. They are not intended to be exhaustive or to limit the present disclosure to the precise forms disclosed, and obviously many modifications and variations are possible in light of the above teaching. The exemplary embodiment was chosen and described in order to best explain the principles of the present disclosure and its practical application, to thereby enable people skilled in the art to best utilize the present disclosure and various embodiments with various modifications as are suited to the particular use contemplated.

What is claimed is:

1. A stencil for use in applying nail polish to a nail, the stencil comprising:

a flange defining a notch having an open end structured to receive at least a portion of a finger therein, the notch also having a closed end positioned opposite the open end; and a retainer extending from the flange and structured to secure the flange to a finger, wherein the flange is structured such that, when the flange is secured to the finger, at least a portion of a tip of the nail extends over the closed end of the notch, and wherein the flange has a surface positioned adjacent the closed end of the notch and structured so as to contact the at least a portion of a tip of the nail when the flange is secured to the finger.

2. The stencil of claim 1 wherein the notch has a pair of opposed side edges, and wherein the flange is structured such that, when the flange is secured to the finger, each side edge of the notch extends coextensively with and directly contacts the nail along an associated side edge of the nail adjacent where the nail side edge contacts the remainder of the finger.

3. The stencil of claim 1 wherein the flange is structured such that, when the flange is secured to the finger, a portion of the flange adjacent each side edge of the notch covers skin and cuticles along the side edge of the nail, thereby preventing polish from contacting the skin and cuticles during application of polish to the nail.

4. The stencil of claim 1 wherein the flange and retainer are structured so as to permit application of polish to the entire surface of the nail extending between the side edges of the flange, when the flange is secured to the finger.

5. The stencil of claim 1 wherein the retainer is structured to extend from a portion of the flange on a first side of the notch to a portion of the flange on a second side of the notch opposite the first side, and is structured to extend only along a side of the finger opposite a side on which the nail is located, to secure the flange to a finger.

6. A stencil for use in applying nail polish to a nail, the stencil comprising a flange having a notch formed therein, the flange being structured to contact the nail such that a portion of the nail directly contacts and extends between a first side edge of the notch and a second side edge of the notch opposite the first side edge, the stencil further comprising a retainer extending from the flange and structured to secure the flange to a finger, wherein the retainer includes a protrusion positioned along each side of a pair of opposing sides of the flange; and a guard movably attachable to the flange, wherein the protrusions are structured to limit movement of the guard with respect to the flange, and wherein the guard has an end sleeve extending outwardly from the guard in a direction parallel to the flange.

7. The stencil of claim 6, wherein the retainer extends between a first end portion and a second end portion of the flange, and only along a side of the finger opposite a side on which the nail is located, to secure the flange to a finger.

8. The stencil of claim 6, wherein the retainer comprises a split ring extending between a first portion and a second portion of the flange.

9. The stencil of claim 6, wherein the retainer comprises a strap having a first end attached to a second end portion of the flange and a second end adapted to be received by a slit formed in a first end portion of the flange.

10. The stencil of claim 6 further comprising a guard coupled to at least one of the flange and the retainer, the guard being spaced apart from the notch and adapted to protect nail polish applied to the nail.

11. The stencil of claim 10, wherein the guard comprises at least one slot for ventilation of a painted nail.

12. The stencil of claim 6, further comprising a mask member operatively coupled to the flange and adapted to contact and cover one or more portions of the nail for blocking application of the nail polish to the covered one or more portions of the nail.

13. The stencil of claim 12, wherein the mask member is configured to have one of a flat shape, a curved shape and a V shape.

14. The stencil of claim 6, wherein the flange comprises at least one marking symbol, each symbol indicating an associated predetermined location at which a mask member may be positioned.

15. The stencil of claim 6 wherein the side edges of the notch are structured so as to be in direct contact with the nail during application of polish to the nail.

16. The stencil of claim 6 wherein the flange is structured such that, when the flange is secured to a finger, a portion of the flange adjacent each side edge of the notch covers skin and cuticles adjacent the nail, thereby preventing polish from contacting the skin and cuticles during application of polish to the nail.

* * * * *

UNITED STATES PATENT AND TRADEMARK OFFICE

CERTIFICATE OF CORRECTION

PATENT NO. : 8,752,563 B2
APPLICATION NO. : 12/902188
DATED : June 17, 2014
INVENTOR(S) : Lieu It is certified that error appears in the above-identified patent and that said Letters Patent is hereby corrected as shown below:

In the Specification

Column 1; Line 25; Delete “offs” and insert --off--.

Column 1; Line 51; Delete “claim” and insert --claims--.

Signed and Sealed this
Ninth Day of September, 2014

Michelle K. Lee

Michelle K. Lee
*Deputy Director of the United States Patent and Trademark Office*